US007497304B2

(12) United States Patent
Matsuoka

(10) Patent No.: US 7,497,304 B2
(45) Date of Patent: Mar. 3, 2009

(54) DEVICE FOR DETECTING FAILURE IN DRIVING POWER SUPPLY FOR ELEVATOR, AND METHOD FOR DETECTING FAILURE IN DRIVING POWER SUPPLY FOR ELEVATOR

(75) Inventor: Tatsuo Matsuoka, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 475 days.

(21) Appl. No.: 10/578,247

(22) PCT Filed: May 27, 2004

(86) PCT No.: PCT/JP2004/007656

§ 371 (c)(1),
(2), (4) Date: May 4, 2006

(87) PCT Pub. No.: WO2005/115901

PCT Pub. Date: Dec. 8, 2005

(65) Prior Publication Data

US 2007/0131488 A1 Jun. 14, 2007

(51) Int. Cl.
*B66B 1/34* (2006.01)

(52) U.S. Cl. ..... 187/393; 187/296; 187/290

(58) Field of Classification Search ..... 187/290, 187/293, 296, 297, 391–393; 318/375, 376, 318/139; 307/66, 69; 320/128, 130–133, 320/135; 361/23, 31, 33
See application file for complete search history.

(56) References Cited

U.S. PATENT DOCUMENTS 4,482,031 A 11/1984 Yoshida et al.
6,435,312 B2 * 8/2002 Tajima et al. ..... 187/290
6,439,348 B2 * 8/2002 Tajima et al. ..... 187/290
6,460,658 B2 * 10/2002 Suga et al. ..... 187/290
6,471,013 B2 * 10/2002 Banno et al. ..... 187/290
6,533,074 B2 * 3/2003 Tominaga et al. ..... 187/290

FOREIGN PATENT DOCUMENTS

| | | |
|---|---|---|
| CN | 1437030 A | 8/2003 |
| JP | 30270/1982 | 2/1982 |
| JP | 8-29465 | 2/1996 |
| JP | 8-157152 | 6/1996 |
| JP | 10-178747 | 6/1998 |
| JP | 11-231008 | 8/1999 |
| JP | 2003-212450 | 7/2003 |

* cited by examiner

*Primary Examiner*—Jonathan Salata
(74) *Attorney, Agent, or Firm*—Oblon, Spivak, McClelland, Maier & Neustadt, P.C.

(57) ABSTRACT

In a feeder circuit for operating a safety device of an elevator, a charging capacitor for actuating an actuator through discharge is employed. A failure detecting device for detecting the presence or absence of a capacitance shortage of a charging capacitor is also electrically connected to the feeder circuit. The failure detecting device has a memory in which a lower limit and upper limit of a charging time at the time when the charging capacitor is in normal operation are stored, and a CPU which is capable of measuring the charging time of the charging capacitor and detects whether or not the charging time is between the lower limit and the upper limit. When the charging time is between the lower limit and the upper limit, the CPU determines that there is no capacitance shortage of the charging capacitor.

2 Claims, 9 Drawing Sheets

DEVICE FOR DETECTING FAILURE IN DRIVING POWER SUPPLY FOR ELEVATOR, AND METHOD FOR DETECTING FAILURE IN DRIVING POWER SUPPLY FOR ELEVATOR

TECHNICAL FIELD

The present invention relates to a failure detecting device for an elevator drive power source and a failure detecting method for an elevator drive power source for detecting a failure in a drive power source of an actuator for operating a safety device of an elevator.

BACKGROUND ART

As disclosed in JP-A 11-231008, there has been a capacitor life assessment device for detecting a capacitance shortage of an electrolytic capacitor built in a power unit in order to assess the life of the electrolytic capacitor. This conventional capacitor life assessment device is adapted to sample the voltage of a capacitor after the charging thereof and assess the life of the capacitor based on a time constant derived from the sampled voltage.

Further, JP-A8-29465 discloses a capacitor capacitance change detection circuit that determines a capacitance shortage of a capacitor from a period of time until the charging voltage of the capacitor reaches a reference voltage. In this conventional capacitor capacitance change detection circuit, the period of time until the charging voltage of the capacitor reaches the reference voltage is measured by an external comparator (hardware comparator) connected to a CPU. The CPU determines a capacitance shortage of the capacitor by reference to information from the comparator.

In the conventional capacitor life assessment device, however, complicated calculations such as logarithmic calculations are required in order to assess the life of the capacitor. This complicates the processings of the calculations, lowers the speed of the processings, and leads to a setback for cost reduction as well.

Further, in the conventional capacitor capacitance change detection circuit, since the comparator is externally connected to the CPU, the soundness of the comparator itself must be checked independently of that of the CPU, and thus the soundness check of the comparator becomes a troublesome task. This makes it difficult to enhance the reliability of the capacitor capacitance change detection circuit.

DISCLOSURE OF THE INVENTION

The present invention has been made to solve the problems as mentioned above, and has an object of obtaining a failure detecting device for an elevator drive power source and a failure detecting method for an elevator drive power source, which can easily and more reliably detect a failure in a drive power source for operating a safety device of an elevator.

According to the present invention, a failure detecting device for an elevator drive power source for detecting whether or not there is an abnormality in a charging capacitance of a charge portion serving as a drive power source that drives an actuator for operating a safety device of an elevator, includes: a determination device comprising: a storage portion in which an upper limit and a lower limit of a charging time of the charge portion at a time when the charging capacitance is normal are stored in advance; and a processing portion which can measure the charging time of the charge portion, for detecting whether or not the charging time is between the upper limit and the lower limit.

BEST MODE FOR CARRYING OUT THE INVENTION

Hereinafter, preferred embodiments of the present invention will be described with reference to the drawings.

Embodiment 1

Figure 1:
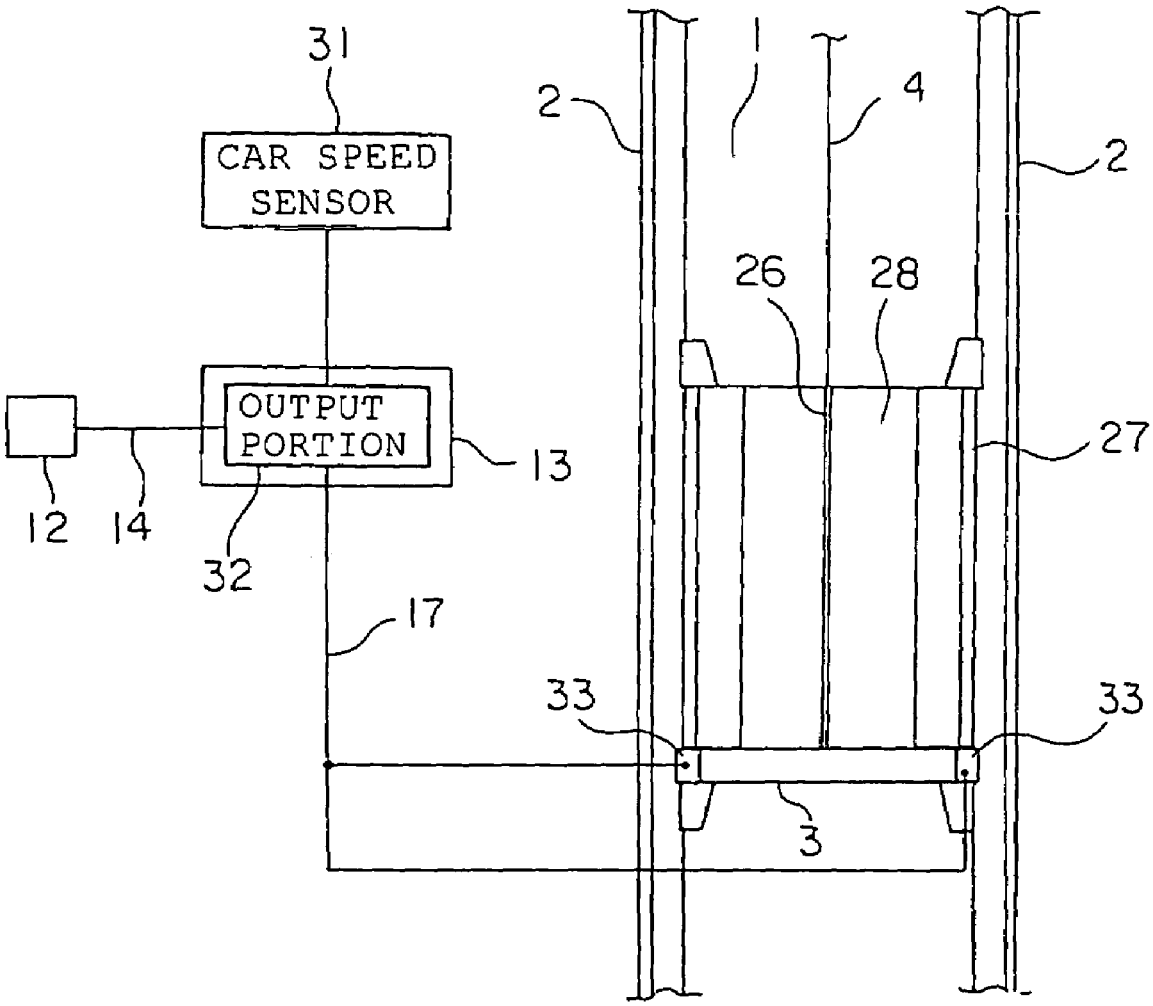
FIG. 1 is a schematic diagram showing an elevator apparatus according to Embodiment 1 of the present invention.

FIG. 1 is a schematic diagram showing an elevator apparatus according to Embodiment 1 of the present invention. Referring to FIG. 1, a pair of car guide rails 2 are arranged within a hoistway 1. A car 3 is guided by the car guide rails 2 as it is raised and lowered in the hoistway 1. Arranged at the upper end portion of the hoistway 1 is a hoisting machine (not shown) for raising and lowering the car 3 and a counterweight (not shown). A main rope 4 is wound around a driving sheave of the hoisting machine. The car 3 and the counterweight are suspended in the hoistway 1 by means of the main rope 4. Mounted to the car 3 are a pair of safety devices 33 opposed to the respective guide rails 2 and serving as braking means. The safety devices 33 are arranged on the underside of the car 3. Braking is applied to the car 3 upon actuating the safety devices 33.

The car 3 has a car main body 27 provided with a car entrance 26, and a car door 28 that opens and closes the car entrance 26. Provided in the hoistway 1 is a car speed sensor 31 serving as car speed detecting means for detecting the speed of the car 3, and a control panel 13 that controls the drive of an elevator.

Mounted inside the control panel 13 is an output portion 32 electrically connected to the car speed sensor 31. The battery 12 is connected to the output portion 32 through the power supply cable 14. Electric power used for detecting the speed of the car 3 is supplied from the output portion 32 to the car speed sensor 31. The output portion 32 is input with a speed detection signal from the car speed sensor 31.

A control cable (movable cable) is connected between the car 3 and the control panel 13. The control cable includes, in addition to multiple power lines and signal lines, an emergency stop wiring 17 electrically connected between the control panel 13 and each safety device 33.

A first overspeed which is set to be higher than a normal operating speed of the car 3 and a second overspeed which is set to be higher than the first overspeed are set in the output portion 32. The output portion 32 actuates a braking device of the hoisting machine when the raising/lowering speed of the car 3 reaches the first overspeed (set overspeed), and outputs an actuation signal that is actuating electric power to the safety device 33 when the raising/lowering speed of the car 3 reaches the second overspeed. The safety device 33 is actuated by receiving the input of the actuation signal.

Figure 2:
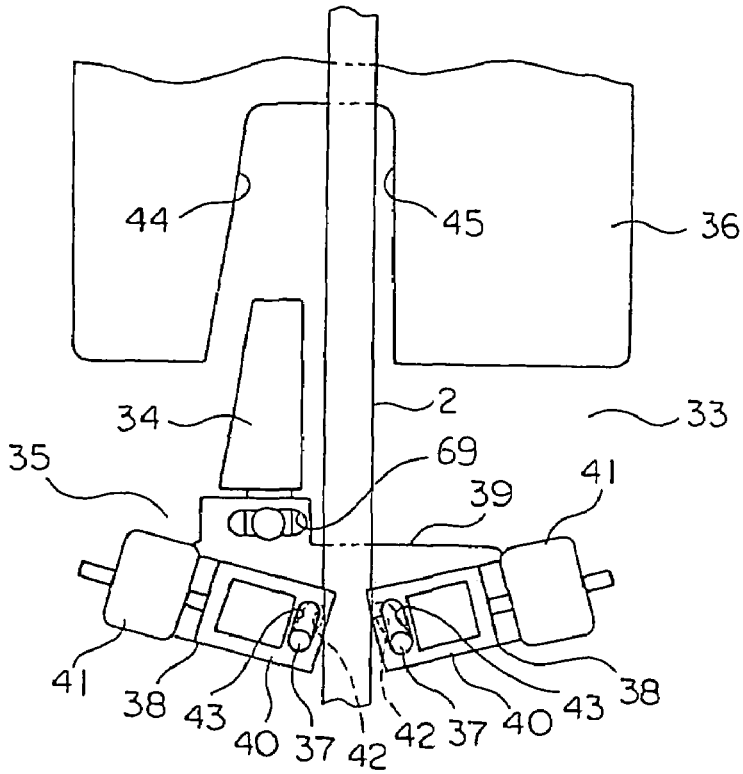
FIG. 2 is a front view showing the safety device shown in FIG. 1.
Figure 3:
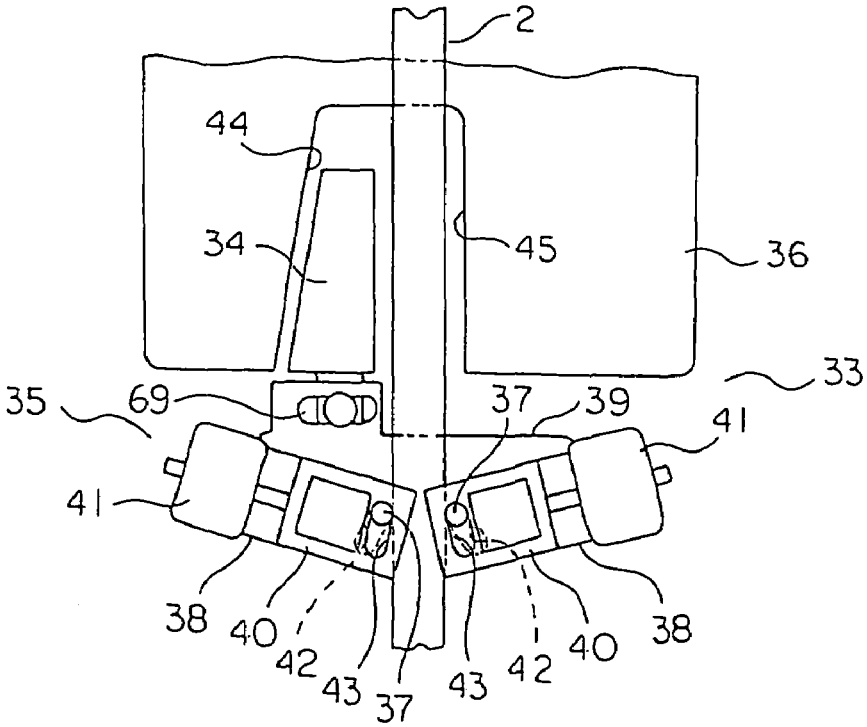
FIG. 3 is a front view of the safety device shown in FIG. 2 during the actuation phase.

FIG. 2 is a front view showing the safety device 33 shown in FIG. 1, and FIG. 3 is a front view of the safety device 33 shown in FIG. 2 during the actuation phase. In the drawings, the safety device 33 has a wedge 34 serving as a braking member which can be moved into and away from contact with the car guide rail 2, a support mechanism portion 35 connected to a lower portion of the wedge 34, and a guide portion 36 which is disposed above the wedge 34 and fixed to the car 3. The wedge 34 and the support mechanism portion 35 are provided so as to be vertically movable with respect to the guide portion 36. The wedge 34 is guided in a direction to come into contact with the car guide rail 2 of the guide portion 36 by its upward displacement with respect to the guide portion 36, i.e., its displacement toward the guide portion 36 side.

The support mechanism portion 35 has cylindrical contact portions 37 which can be moved into and away from contact with the car guide rail 2, actuation mechanisms 38 for displacing the respective contact portions 37 in a direction along which the respective contact portions 37 are moved into and away from contact with the car guide rail 2, and a support portion 39 for supporting the contact portions 37 and the actuation mechanisms 38. The contact portion 37 is lighter than the wedge 34 so that it can be readily displaced by the actuation mechanism 38. The actuation mechanism 38 has a contact portion mounting member 40 which can make the reciprocating displacement between a contact position where the contact portion 37 is held in contact with the car guide rail 2 and a separated position where the contact portion 37 is separated away from the car guide rail 2, and an actuator 41 for displacing the contact portion mounting member 40.

The support portion 39 and the contact portion mounting member 40 are provided with a support guide hole 42 and a movable guide hole 43, respectively. The inclination angles of the support guide hole 42 and the movable guide hole 43 with respect to the car guide rail 2 are different from each other. The contact portion 37 is slidably fitted in the support guide hole 42 and the movable guide hole 43. The contact portion 37 slides within the movable guide hole 43 according to the reciprocating displacement of the contact portion mounting member 40, and is displaced along the longitudinal direction of the support guide hole 42. As a result, the contact portion 37 is moved into and away from contact with the car guide rail 2 at an appropriate angle. When the contact portion 37 comes into contact with the car guide rail 2 as the car 3 descends, braking is applied to the wedge 34 and the support mechanism portion 35, displacing them toward the guide portion 36 side.

Mounted on the upperside of the support portion 39 is a horizontal guide hole 69 extending in the horizontal direction. The wedge 34 is slidably fitted in the horizontal guide hole 69. That is, the wedge 34 is capable of reciprocating displacement in the horizontal direction with respect to the support portion 39.

The guide portion 36 has an inclined surface 44 and a contact surface 45 which are arranged so as to sandwich the car guide rail 2 therebetween. The inclined surface 44 is inclined with respect to the car guide rail 2 such that the distance between it and the car guide rail 2 decreases with increasing proximity to its upper portion. The contact surface 45 is capable of moving into and away from contact with the car guide rail 2. As the wedge 34 and the support mechanism portion 35 are displaced upward with respect to the guide portion 36, the wedge 34 is displaced along the inclined surface 44. As a result, the wedge 34 and the contact surface 45 are displaced so as to approach each other, and the car guide rail 2 becomes lodged between the wedge 34 and the contact surface 45.

Figure 4:
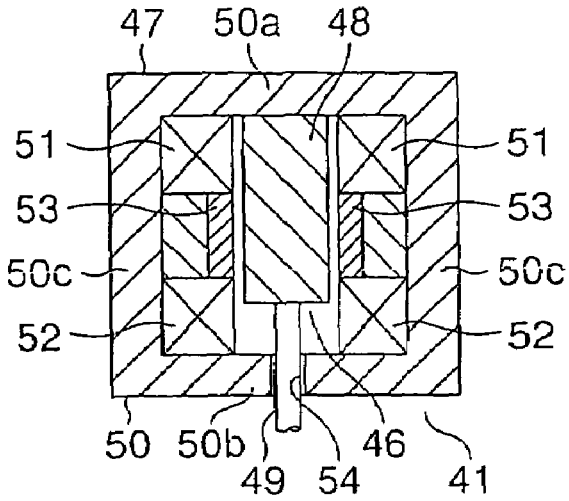
FIG. 4 is a schematic cross sectional view showing the actuator shown in FIG. 2.
Figure 5:
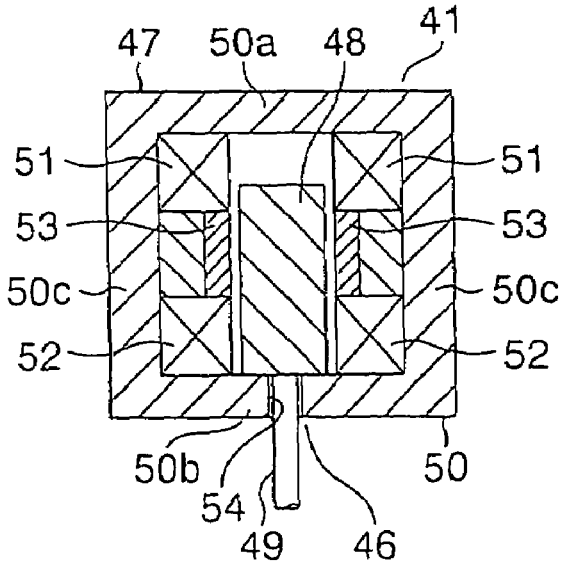
FIG. 5 is a schematic cross sectional view showing a state when the movable iron core shown in FIG. 4 is located in the actuation position.

FIG. 4 is a schematic cross sectional view showing the actuator 41 shown in FIG. 2. In addition, FIG. 5 is a schematic cross sectional view showing a state when the movable iron core 48 shown in FIG. 4 is located in the actuation position. In the drawings, the actuator 41 has a connection portion 46 connected to the contact portion mounting member 40 (FIG. 2), and a driving portion 47 for displacing the connection portion 46.

The connection portion 46 has a movable iron core (movable portion) 48 accommodated within the driving portion 47, and a connection rod 49 extending from the movable iron core 48 to the outside of the driving portion 47 and fixed to the contact portion mounting member 40. Further, the movable iron core 48 can be displaced between an actuation position (FIG. 5) where the contact portion mounting member 40 is displaced to the contact position to actuate the safety device 33 and a normal position (FIG. 4) where the contact portion mounting member 40 is displaced to the separated position to release the actuation of the safety device 33.

The driving portion 47 has: a fixed iron core 50 which has a pair of regulating portions 50*a* and 50*b* for regulating the displacement of the movable iron core 48 and a sidewall portion 50*c* for connecting therethrough the regulating portions 50*a* and 50*b* to each other and which encloses the movable iron core 48; a first coil 51 accommodated within the fixed iron core 50 for displacing the movable iron core 48 in a direction along which the movable iron core 48 comes into contact with one regulating portion 50*a* by causing a current to flow through the first coil 51; a second coil 52 accommodated within the fixed iron core 50 for displacing the movable iron core 48 in a direction along which the movable iron core 48 comes into contact with the other regulating portion 50*b* by causing a current to flow through the second coil 52; and an annular permanent magnet 53 disposed between the first coil 51 and the second coil 52.

A through hole 54 through which the connection rod 49 is inserted is provided in the other regulating portion 50*b*. The movable iron core 48 abuts on one regulating portion 50*a* when being located in the normal position, and abuts on the other regulating portion 50*b* when being located in the actuation position.

The first coil 51 and the second coil 52 are annular electromagnetic coils surrounding the connection portion 46. In addition, the first coil 51 is disposed between the permanent magnet 53 and one regulating portion 50*a*, and the second coil 51 is disposed between the permanent magnet 53 and the other regulating portion 50*b*.

In a state in which the movable iron core 48 abuts on one regulating portion 50*a*, a space forming the magnetic resistance exists between the movable iron core 48 and the other regulating portion 50*b*. Hence, the amount of magnetic flux of the permanent magnet 53 becomes more on the first coil 51 side than on the second coil 52 side, and thus the movable iron core 48 is held in abutment with one regulating portion 50*a*.

Further, in a state in which the movable iron core 48 abuts on the other regulating portion 50*b*, a space forming the magnetic resistance exists between the movable iron core 48 and one regulating portion 50*a*. Hence, the amount of magnetic flux of the permanent magnet 53 becomes more on the second coil 52 side than on the first coil 51 side, and thus the movable iron core 48 is held in abutment with the other regulating portion 50*b*.

An actuating electric power serving as an actuation signal from the output portion 32 is inputted to the second coil 52. Upon being inputted the actuation signal, the second coil 52 generates a magnetic flux that acts against a force maintaining abutment of the movable iron core 48 on one of the regulating portions 50*a*. On the other hand, recovery electric power serving as a recovery signal from the output portion 32 is inputted to the first coil 51. Upon being inputted the recovery signal, the first coil 51 generates a magnetic flux that acts against a force maintaining abutment of a movable iron core 48 on the other regulating portion 50*b*.

Figure 6:
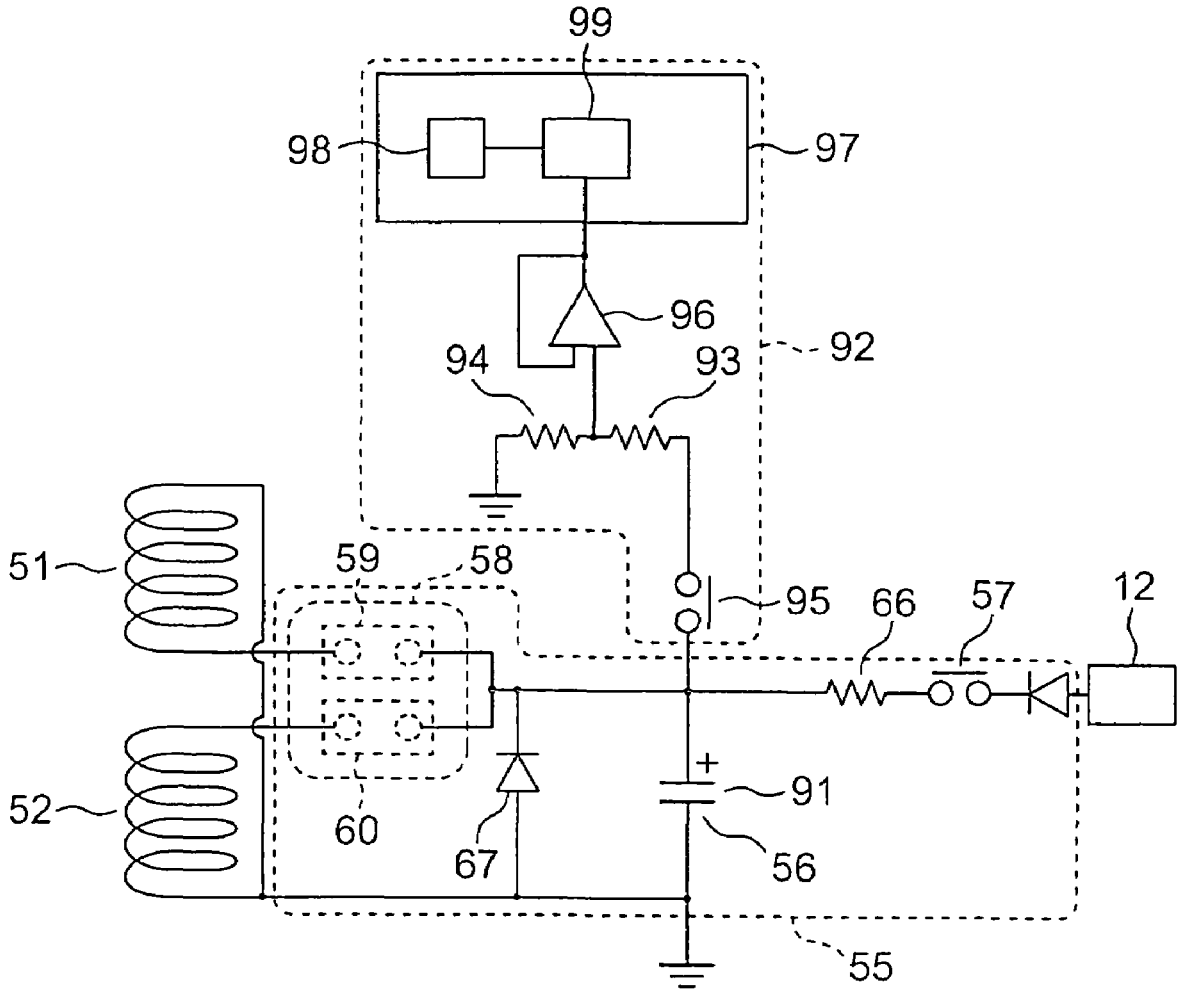
FIG. 6 is a circuit diagram showing a part of an internal circuit of the output portion of FIG. 1.

FIG. 6 is a circuit diagram showing a part of an internal circuit of the output portion 32 of FIG. 1. Referring to the figure, the output portion 32 is provided with a feeder circuit 55 for supplying electric power to the actuator 41. The feeder circuit 55 has a charge portion (drive power source) 56 that can be charged with electric power from the battery 12, a charge switch 57 for charging the charge portion 56 with the electric power of the battery 12, and a discharge switch 58 that selectively discharges the electric power with which the charge portion 56 is charged to the first coil 51 and the second coil 52. The movable iron core 48 (FIG. 4) can be displaced when the electric power is discharged from the charge portion 56 to one of the first coil 51 and second coil 52.

The discharge switch 58 has a first semiconductor switch 59 that discharges the electric power with which the charge portion 56 is charged to the first coil 51 as a recovery signal, and a second semiconductor switch 60 that discharges the electric power with which the charge portion 56 is charged to the second coil 52 as an actuation signal.

The charge portion 56 has a charging capacitor 91, which is an electrolytic capacitor. Provided in the feeder circuit 55 are a charge resistor 66, which is an internal resistance of the feeder circuit 55, and a diode 67 that is connected in parallel to the charging capacitor 91 to prevent a surge voltage from being applied to the charging capacitor 91.

A failure detecting device for a drive power source 92 (hereinafter referred to simply as "a failure detecting device 92") for detecting the presence or absence of an abnormality in charge capacitance of the charging capacitor 91, namely, the presence or absence of a capacitance shortage of the charging capacitor 91 is electrically connected to the feeder circuit 55.

The failure detecting device 92 has first and second voltage-dividing resistors 93 and 94 for dividing the charging voltage of the charging capacitor 91, a contact for a charging voltage detection relay 95 for electrically connecting the first and second voltage-dividing resistors 93 and 94 to the feeder circuit 55, a voltage follower operational amplifier 96 that is electrically connected between the first and second voltage-dividing resistors 93 and 94 to pick up the charging voltage obtained as a result of voltage division carried out by the first and second voltage-dividing resistors 93 and 94, and a determination device 97 that detects the presence or absence of a capacitance shortage of the charging capacitor 91 based on the charging voltage picked up by the operational amplifier 96.

The resistance values of the first and second voltage-dividing resistors 93 and 94 are set sufficiently larger than the resistance value of the charge resistor 66.

When the charge switch 57 is thrown and the supply of electric power from the battery 12 to the charging capacitor 91 is started, the contact for the charging voltage detection relay 95 is thrown. When the supply of electric power to the charging capacitor 91 is stopped, the contact for the charging voltage detection relay 95 is opened. In other words, the contact for the charging voltage detection relay 95 is ON during the supply of electric power to the charging capacitor 91, and OFF during the stoppage of the supply of electric power to the charging capacitor 91.

The determination device 97 has a memory 98, which is a storage portion in which reference data are stored in advance, and a CPU 99, which is a processing portion that determines the presence or absence of a capacitance shortage of the charging capacitor 91 based on information from the memory 98 and operational amplifier 96.

It should be noted herein that the charging capacitor 91 has such a characteristic that the period of time until a prescribed charging voltage is obtained decreases as the capacitance shortage of the capacitor increases. Accordingly, the degree of capacitance shortage of the charging capacitor 91 can be checked by measuring the charging time of the charging capacitor 91.

Figure 7:
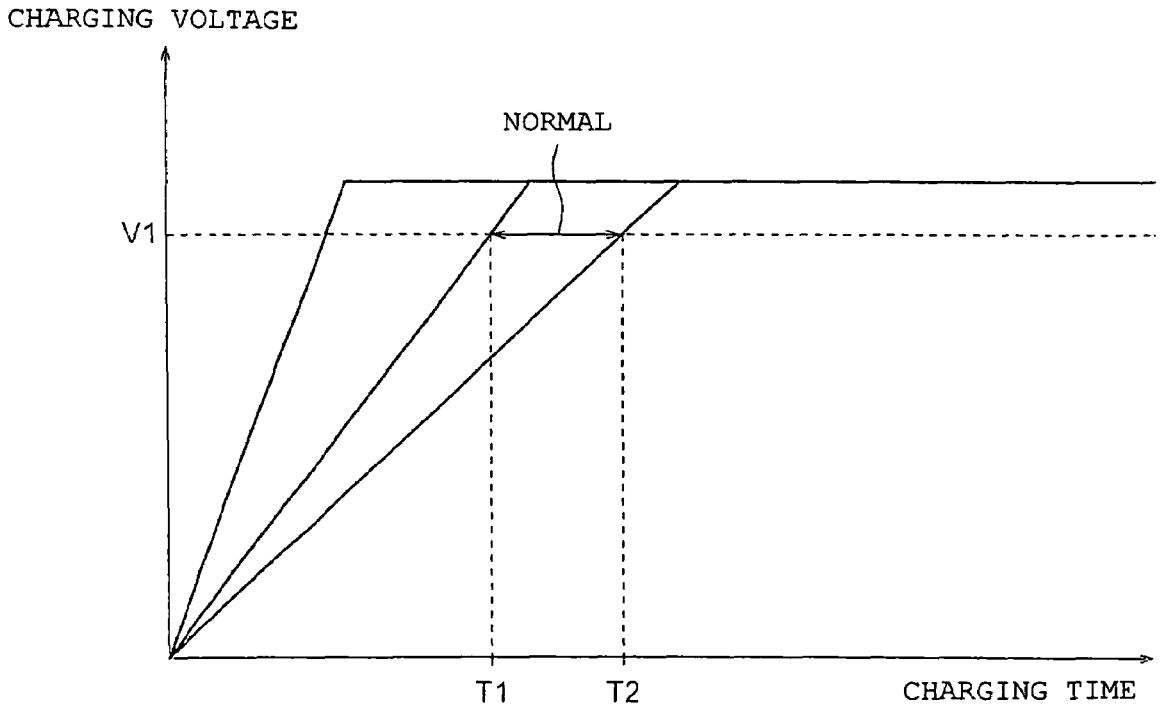
FIG. 7 is a graph showing a relationship between charging voltage and charging time in the charging capacitor of FIG. 6.

FIG. 7 is a graph showing a relationship between charging voltage and charging time in the charging capacitor 91 of FIG. 6. A set value V1 set in advance as a prescribed value of charging voltage and a lower limit T1 and upper limit T2 of the charging time of the charging capacitor 91 at the time when the charging capacitor 91 has a normal charging capacitance are stored in the memory 98 as the reference data. The charging time of the charging capacitor 91 is a time extending from a moment when the charging capacitor 91 starts to be charged to a moment when the charging voltage reaches the set value V1.

For instance, it is assumed that E denotes the charging power source voltage of the battery 12, that R denotes a charging resistance, and that C denotes the capacitance of the charging capacitor 91. In this case, after the lapse oft seconds from the start of charging, the charging capacitor 91 has a charging voltage Vt as expressed below.

$$Vt=E\cdot\{1-\exp(-t/CR)\} \quad (1)$$

If the set value V1 is set as k % of a charging completion voltage (k % of the charging power source voltage), a charging period of time $t_{v1}$, until V1 is reached is derived from the equation (1) as follows.

$$t_{v1}=-CR\cdot ln(1-k) \quad (2)$$

If it is assumed herein that both the capacitance C of the charging capacitor 91 and the charging resistance R have an allowable range (accuracy) of ±10%, that the capacitance C is 40 mF, that the charging resistance R is 50 Ω, that the charging power source voltage E of the battery 12 is 48 V, and that k=90%, the set value V1, the lower limit T1, and the upper limit T2 are derived from the above definition of the set value V1 and the equation (2) as follows.

$$V1=0.9\times48\approx43.2\ V \quad (3)$$

$$T1=-0.9^2CR\cdot ln0.1\approx3.7 \text{ seconds} \quad (4)$$

$$T2=-1.1^2CR\cdot ln0.1\approx5.6 \text{ seconds} \quad (5)$$

The set value V1, the lower limit T1, and the upper limit T2, which have thus been calculated in advance, are stored in the memory 98.

An A/D converter (not shown) that performs A/D conversion of the charging voltage picked up by the operational amplifier 96, and a charging timer (not shown) for measuring the charging time are built in the CPU 99. When a voltage from the operational amplifier 96 is inputted to the CPU 99, the charging timer is actuated (started) When the voltage subjected to A/D conversion by the A/D converter reaches the set value V1, the charging timer is halted (stopped). Thus, the charging time of the charging capacitor 91 is measured.

When the charging time measured by the charging timer is within an allowable range between the lower limit T1 and the upper limit T2, the CPU 99 detects no abnormality in the charging capacitor 91. When the charging time measured by the charging timer is outside the allowable range, the CPU 99 detects an abnormality ascribable to a capacitance shortage of the charging capacitor 91.

Next, an operation will be described. During normal operation, a contact portion mounting member 40 is located at an opened and separated position, and the movable iron core 48 is located at a normal position. In this state, a wedge 34 is spaced apart from a guide portion 36, and opened and separated from a car guide rail 2. Further, in this state, both the first semiconductor switch 59 and the second semiconductor switch 60 are off. Furthermore, during normal operation, the charging capacitor 91 is charged with the electric power from the battery 12.

When the speed detected by a car speed sensor 31 becomes equal to a first overspeed, the braking device of a hoisting machine is actuated. When the speed of a car 3 rises thereafter as well and the speed detected by the car speed sensor 31 becomes equal to a second overspeed, the second semiconductor switch 60 is turned on, and the electric power with which the charging capacitor 91 is charged is discharged to the second coil 52 as an actuation signal. In other words, the actuation signal is outputted from the output portion 32 to respective safety devices 33.

Thus, a magnetic flux is generated around the second coil 52, and the movable iron core 48 is displaced in such a direction as to approach the other regulating portion 50*b*, namely, from the normal position to an actuation position (FIGS. 4 and 5). Thus, contact portions 37 are pressed into contact with the car guide rail 2, and the wedge 34 and the support mechanism portion 35 are braked (FIG. 3). Due to a magnetic force of a permanent magnet 53, the movable iron core 48 is held at the actuation position while abutting on the other regulating portion 50*b*.

Since the car 3 and the guide portion 36 are lowered without being braked, the guide portion 36 is displaced downward to the side of the wedge 34 and the support mechanism portion 35. Owing to this displacement, the wedge 34 is guided along an inclined surface 44 so that the car guide rail 2 is sandwiched between the wedge 34 and a contact surface 45. Due to contact with the car guide rail 2, the wedge 34 is displaced further upward to be wedged in between the car guide rail 2 and the inclined surface 44. A large frictional force is thus generated between the car guide rail 2 on one hand and the wedge 34 and the contact surface 45 on the other hand, so that the car 3 is braked.

During recovery, the car 3 is raised with the movable iron core 48 at the actuation position, that is, with the contact portion 37 in contact with the car guide rail 2, so that the wedge 34 is released. The second semiconductor switch 60 is thereafter turned off, and the charging capacitor 91 is recharged with the electric power of the battery 12. After that, the first semiconductor switch 59 is turned on. In other words, a recovery signal is transmitted from the output portion 32 to the respective safety devices 33. The first coil 51 is thereby energized, so that the movable iron core 48 is displaced from the actuation position to the normal position. The contact portion 37 is thereby opened and separated from the car guide rail 2, thus completing the process of recovery.

Next, the procedure and operation in conducting failure inspection for the presence or absence of an abnormality in the charging capacitor 91 will be described.

Figure 8:
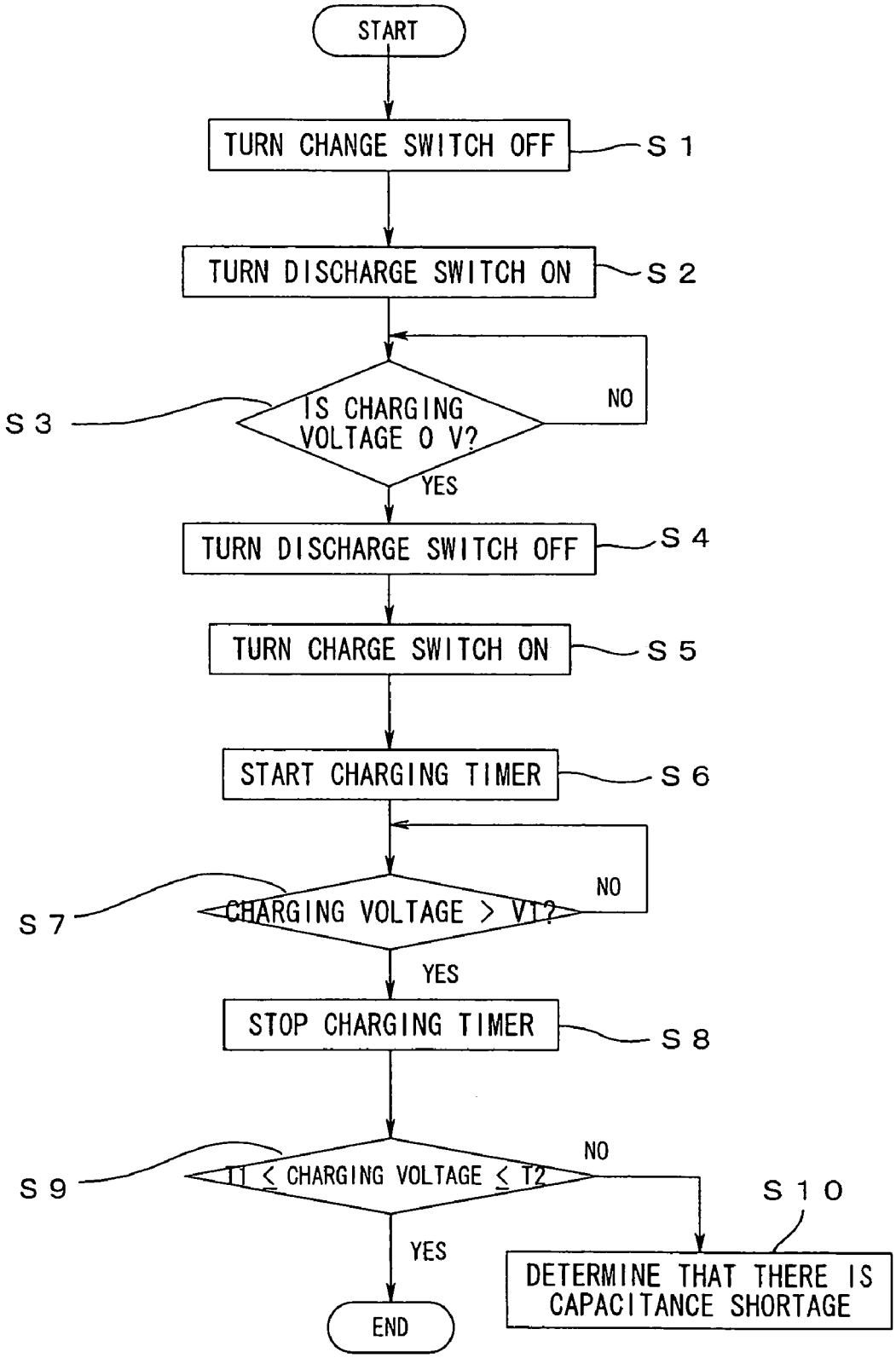
FIG. 8 is a flowchart showing the control operation of a determination device of FIG. 6.

FIG. 8 is a flowchart showing the control operation of a determination device 97 of FIG. 6. Referring to the figure, during failure inspection, the charge switch 57 is turned off (OFF state) (S1) in response to a command from the determination device 97, and the second semiconductor switch 60 is then turned on (ON state) (S2). Thus, the electric power with which the charging capacitor 91 is charged is discharged to the second coil 52. This state is maintained by the determination device 97 until the electric power accumulated in the charging capacitor 91 is completely discharged (S3). When the charging voltage of the charging capacitor 91 becomes 0 V, the second semiconductor switch 60 is turned off in response to a command from the determination device 97 (S4).

After that, the charge switch 57 is turned on in response to a command from the determination device 97 (S5). Thus, the contact for the charging voltage detection relay 95 is closed. At the same time, the charging timer built in the CPU 99 starts to operate (S6). By turning the contact for the charging voltage detection relay 95 on, information on the charging voltage of the charging capacitor 91 is inputted to the CPU 99. This state is maintained by the determination device 97 until the charging voltage of the charging capacitor 91 reaches the set value V1 (S7). When the charging voltage of the charging capacitor 91 reaches the set value V1, the charging timer is stopped (S8). After that, the CPU 99 turns the charge switch 57 and the charging voltage detection relay 97 off, thus completing the charging of the charging capacitor 91.

The CPU 99 detects whether or not the charging time measured by the charging timer is within the allowable range between the lower limit T1 and the upper limit T2 (S9). When the charging time is within the allowable range, the processing operation of the CPU 99 is terminated (S10). On the other hand, when the charging time is outside the allowable range, the CPU 99 determines that the charging capacitor 91 is abnormal.

In the failure detecting device as described above, the CPU 99 can measure the charging time of the charging capacitor 91 and detects whether or not the charging time of the charging capacitor 91 is between the lower limit T1 and the upper limit T2, thus making it possible to easily check whether or not there is a capacitance shortage of the charging capacitor 91 without performing any complicated processings such as logarithmic calculations. Further, since the CPU 99 measures the charging time of the charging capacitor 91 and checks whether or not there is a capacitance shortage of the charging capacitor 91, there is no need to mount an external device such as a hardware comparator on the CPU. This eliminates the necessity to check the soundness of the external device and thus makes it possible to enhance the reliability in detecting a failure in the charging capacitor 91. Therefore, a failure in the drive power source can be detected more reliably.

Embodiment 2

Figure 9:
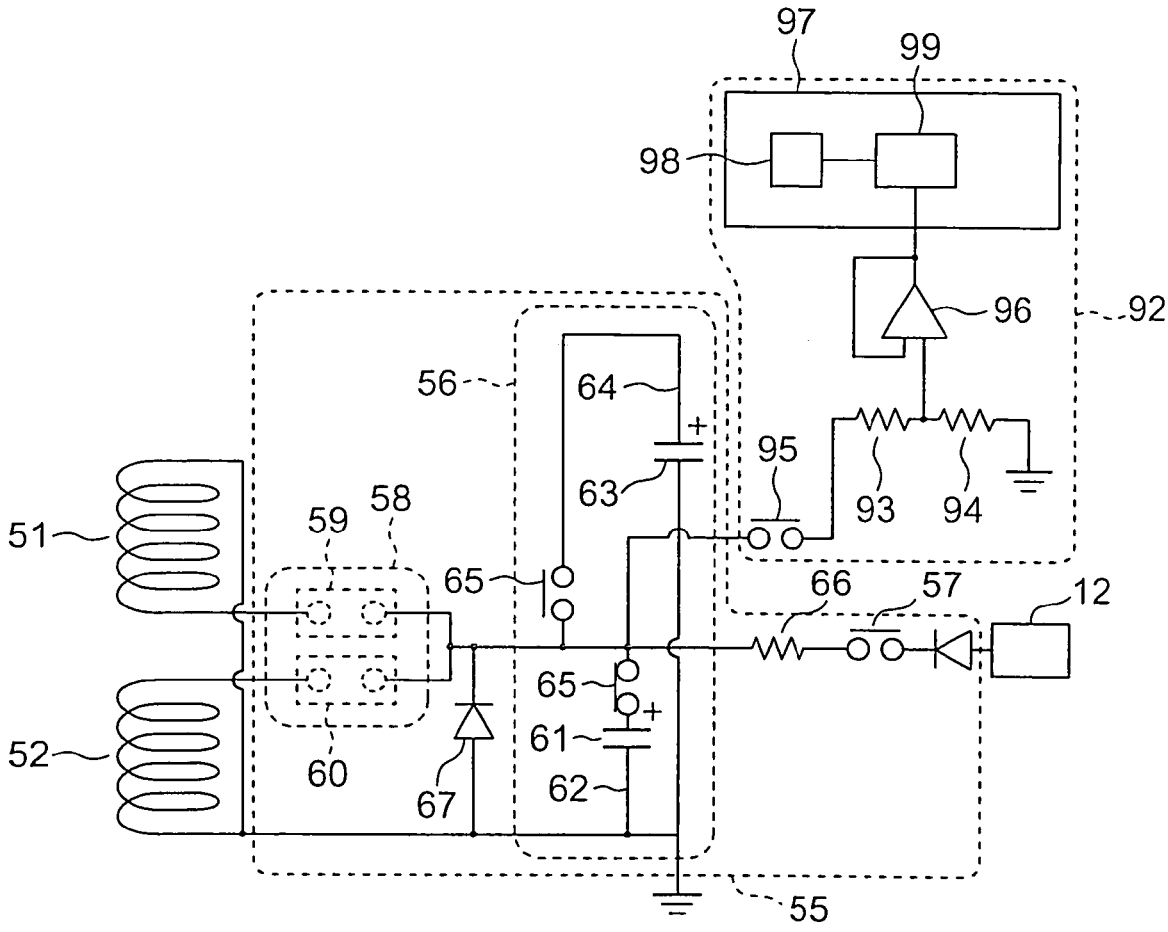
FIG. 9 is a circuit diagram showing a feeder circuit of an elevator apparatus according to Embodiment 2 of the present invention.

FIG. 9 is a circuit diagram showing a feeder circuit of an elevator apparatus according to Embodiment 2 of the present invention. Referring to the figure, the charge portion 56 has a normal mode feeder circuit 62 having a normal mode capacitor (charging capacitor) 61, which is a drive power source, an inspection mode feeder circuit 64 having an inspection mode capacitor 63, which is an electrolytic capacitor that is smaller in charging capacitance than the normal mode capacitor 61, and a changeover switch 65 capable of making a selective changeover between the normal mode feeder circuit 62 and the inspection mode feeder circuit 64.

The normal mode capacitor 61 has such a charging capacitance that the second coil 52 can be supplied with a full-operation current amount for displacing the movable iron core 48 from the normal position (FIG. 4) to the actuation position (FIG. 5).

The inspection mode capacitor 63 has such a charging capacitance that the second coil 52 can be supplied with a semi-operation current amount for displacing the movable iron core 48 from the normal position only to a semi-operation position located between the actuation position and the normal position, namely, a current amount smaller than the full-operation current amount. In addition, when the movable iron core 48 is at the semi-operation position, it is pulled back to the normal position due to a magnetic force of the permanent magnet 53. In other words, the semi-operation position is closer to the normal position than a neutral position where the magnetic force of the permanent magnet 53 acting on the movable iron core 48 is balanced between the normal position and the actuation position. The charging capacitance of the inspection mode capacitor 63 is preset through an analysis or the like such that the movable iron core 48 is displaced between the semi-operation position and the normal position.

The normal mode capacitor 61 can be charged with the electric power from the battery 12 through a changeover made by the changeover switch 65 when the elevator is in normal operation (normal mode). The inspection mode capacitor 63 can be charged with the electric power from the battery 12 through a changeover made by the changeover switch 65 when the operation of the actuator 41 is inspected (inspection mode). Embodiment 2 is the same as Embodiment 1 in respect of other constructional details.

Next, an operation will be described. During normal operation, the changeover switch 65 holds the normal mode feeder circuit 62 in the normal mode, so that the normal mode capacitor 61 is charged with the electric power from the battery 12. After the speed detected by the car speed sensor 31 has become equal to the second overspeed, the operation of Embodiment 2 is the same as that of Embodiment 1, that is, the respective safety devices 33 are actuated through the discharge of electric power from the normal mode capacitor 61 to the second coil 52.

Embodiment 2 is the same as Embodiment 1 in respect of the operation during recovery as well, and the respective safety devices 33 are recovered through the discharge of electric power from the normal mode capacitor 61 to the first coil 51.

Next, the respective procedures in inspecting the operation of the actuator 41 and a capacitance shortage of the normal mode capacitor 61 will be described.

First of all, the charge switch 57 is turned off, and the first semiconductor switch 59 is then thrown to discharge the electric power with which the normal mode capacitor 61 is charged.

Then, the changeover switch 65 is operated to disconnect the battery 12 from the normal mode feeder circuit 62 and connect it to the inspection mode feeder circuit 64. After that, the charge switch 57 is turned on to charge the inspection mode capacitor 63 with the electric power of the battery 12. After the charge switch has been turned off, the second semiconductor switch 60 is thrown to energize the second coil 52. As a result, the movable iron core 48 is displaced between the normal position and the semi-operation position.

When the actuator 41 operates normally, the movable iron core 48 is displaced from the normal position to the semi-operation position and then pulled back to the normal position again. In accordance with this process, the contact portion mounting member 40 and the contact portion 37 are also smoothly displaced. That is the movable iron core 48, the contact portion mounting member 40, and the contact portion 37 are normally semi-operated.

When the actuator 41 has an abnormality in the operation, the movable iron core 48, the contact portion mounting member 40, and the contact portion 37 are not normally semi-operated as described above. The presence or absence of an abnormality in the operation of the actuator 41 is inspected in this manner.

After the operation of the actuator 41 has been inspected, the changeover switch 65 is operated to make a changeover from the inspection mode to the normal mode. The charge switch 57 is then turned on. At this moment, the contact for the charging voltage detection relay 95 is turned on as well. The normal mode capacitor 61 is thereby charged with the electric power of the battery 12, and information on the charging voltage of the normal mode capacitor 61 is inputted to the CPU 99.

Then, in the same manner as in Embodiment 1, the CPU 99 checks whether or not there is a capacitance shortage of the normal mode capacitor 61. After the check with respect to the normal mode capacitor 61 has been ended and the charging of the charge switch 57 has been completed, the charge switch 57 is turned off in response to a command from the CPU 99.

Thus, with the elevator apparatus having the actuator 41 whose operation can be inspected as well, the presence or absence of an abnormality in the normal mode capacitor 61 can be easily inspected for. This makes it possible to check whether or not there is a capacitance shortage of the normal mode capacitor 61 while inspecting the operation of the actuator 41. As a result, the respective safety devices 33 can be effectively inspected.

Embodiment 3

Figure 10:
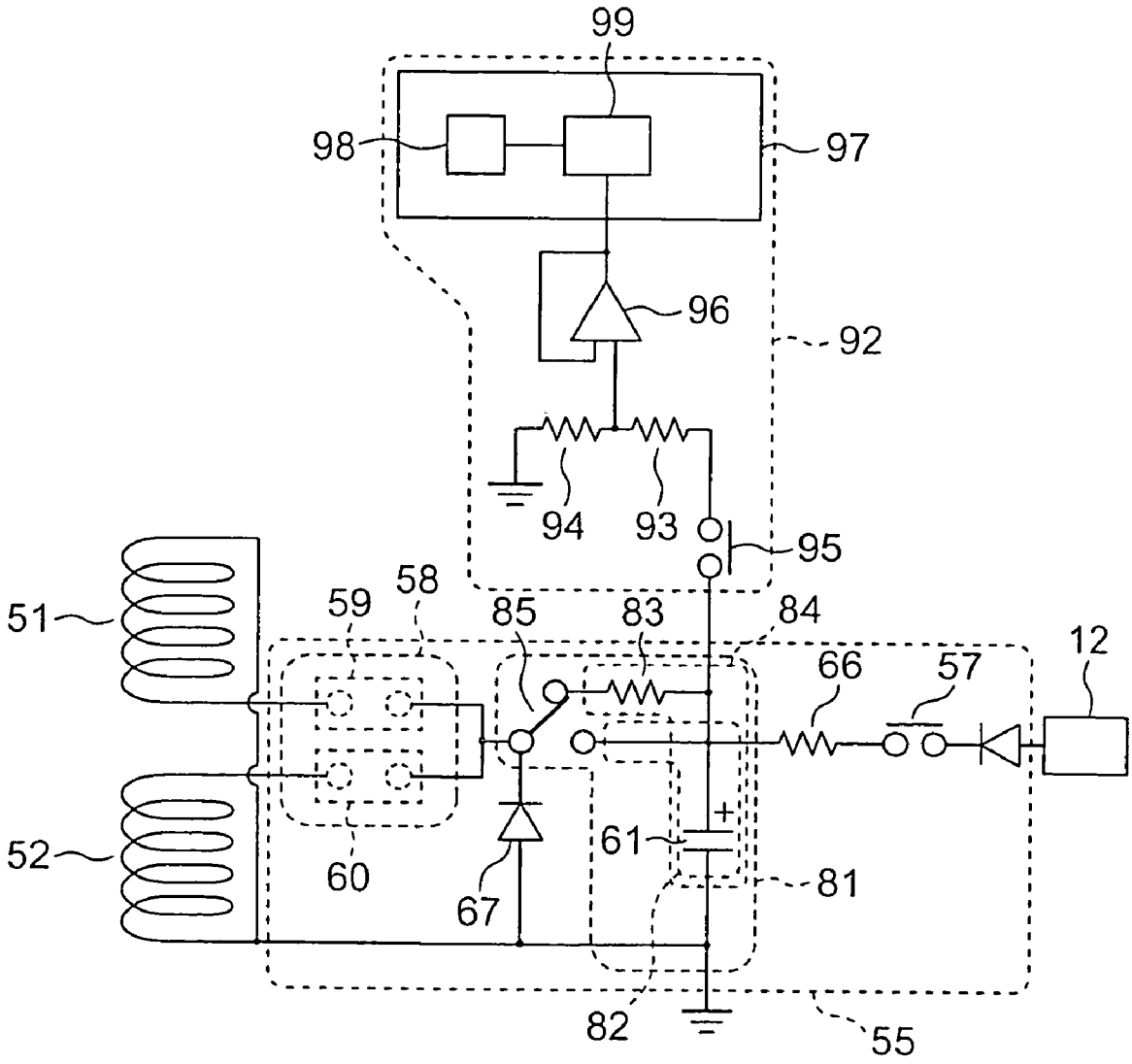
FIG. 10 is a circuit diagram showing a feeder circuit of an elevator apparatus according to Embodiment 3 of the present invention.

FIG. 10 is a circuit diagram showing a feeder circuit of an elevator apparatus according to Embodiment 3 of the present invention. Referring to the figure, a charge portion 81 has a normal mode feeder circuit 82 including the normal mode capacitor 61, which is the same as that of Embodiment 2, an inspection mode feeder circuit 84 having a configuration in which an inspection mode resistor 83 set in advance to a predetermined resistance is added to the normal mode feeder circuit 82, and a changeover switch 85 capable of selectively establishing electrical connection between a discharge switch 58, and the normal mode feeder circuit 82 or the inspection mode feeder circuit 84.

In the inspection mode feeder circuit 84, the normal mode capacitor 61 and the inspection mode resistor 83 are connected in series to each other. Further, the normal mode capacitor 61 can be charged with the electric power of the battery 12 by turning the charge switch 57 on. Embodiment 3 is the same as Embodiment 1 in respect of other constructional details.

Next, an operation will be described. During normal operation, the changeover switch 85 maintains electrical contact between the discharge switch 58 and the normal mode feeder circuit 82 (normal mode). Embodiment 3 is the same as Embodiment 2 in respect of the operation in the normal mode.

Next, the respective procedures and operations in inspecting the operation of the actuator 41 and for a capacitance shortage of the normal mode capacitor 61 will be described.

First of all, the charge switch 57 is turned off, and the first semiconductor switch 59 is then thrown to discharge the electric power with which the normal mode capacitor 61 is charged.

After that, the changeover switch 85 is operated to disconnect the normal mode feeder circuit 82 from the discharge switch 58 and connect the inspection mode feeder circuit 84 thereto. The charge switch 57 is then turned on. At this moment, the contact for the charging voltage detection relay 95 is turned on as well. The normal mode capacitor 61 is thereby charged with the electric power of the battery 12, and information on the charging voltage of the normal mode capacitor 61 is inputted to the CPU 99.

After that, in the same manner as in Embodiment 1, the CPU 99 checks whether or not there is a capacitance shortage of the normal mode capacitor 61. After the check with respect to the normal mode capacitor 61 has been ended and the charging of the charge switch 57 has been completed, the charge switch 57 is turned off in response to a command from the CPU 99.

Then, the second semiconductor switch 60 is thrown to energize the second coil 52. At this moment, since the inspection mode resistor 83 is connected in series to the normal mode capacitor 61 in the inspection mode feeder circuit 82, a part of electric energy discharged from the normal mode capacitor 61 is consumed by the inspection mode resistor 83, so that the second coil 52 is supplied with a current amount smaller than the full-operation current amount.

When the actuator 41 operates normally, the movable iron core 48 is displaced from the normal position to the semi-operation position and then pulled back to the normal position again. In accordance with this process, the contact portion mounting member 40 and the contact portion 37 are also smoothly displaced. That is, the movable iron core 48, the contact portion mounting member 40, and the contact portion 37 are normally semi-operated.

When the actuator 41 has an abnormality in the operation, the movable iron core 48, the contact portion mounting member 40, and the contact portion 37 are not normally semi-operated as described above. The presence or absence of an abnormality in the operation of the actuator 41 is inspected in this manner.

After the completion of inspection, the changeover switch 85 is operated to make a changeover from the inspection mode to the normal mode, and the charge switch 57 is then thrown to charge the normal mode capacitor 61 with the electric power of the battery 12.

Thus, with the elevator apparatus having the actuator 41 whose operation can be inspected as well, the presence or absence of an abnormality in the normal mode capacitor 61 can be easily inspected for. This makes it possible to check whether or not there is a capacitance shortage of the normal mode capacitor 61 while inspecting the operation of the actuator 41. As a result, the respective safety devices 33 can be effectively inspected.

In Embodiments 2 and 3, the movable iron core 48 is pulled back from the semi-operation position to the normal position only due to the magnetic force of the permanent magnet 53. However, the movable iron core 48 may be returned from the semi-operation position to the normal position due to the bias of a recovery spring as well as the magnetic force of the permanent magnet 53. This makes it possible to more reliably semi-operate the movable iron core 48.

With the construction of Embodiment 1 as well, the movable iron core 48 can be displaced between the semi-operation position and the normal position by using a recovery spring acting as resistance to displacement of the movable iron core 48 from the normal position to the side of the actuation position. This makes it possible to inspect not only for a capacitance shortage of the charging capacitor 91 but also the operation of the actuator 41.

Embodiment 4

Figure 11:
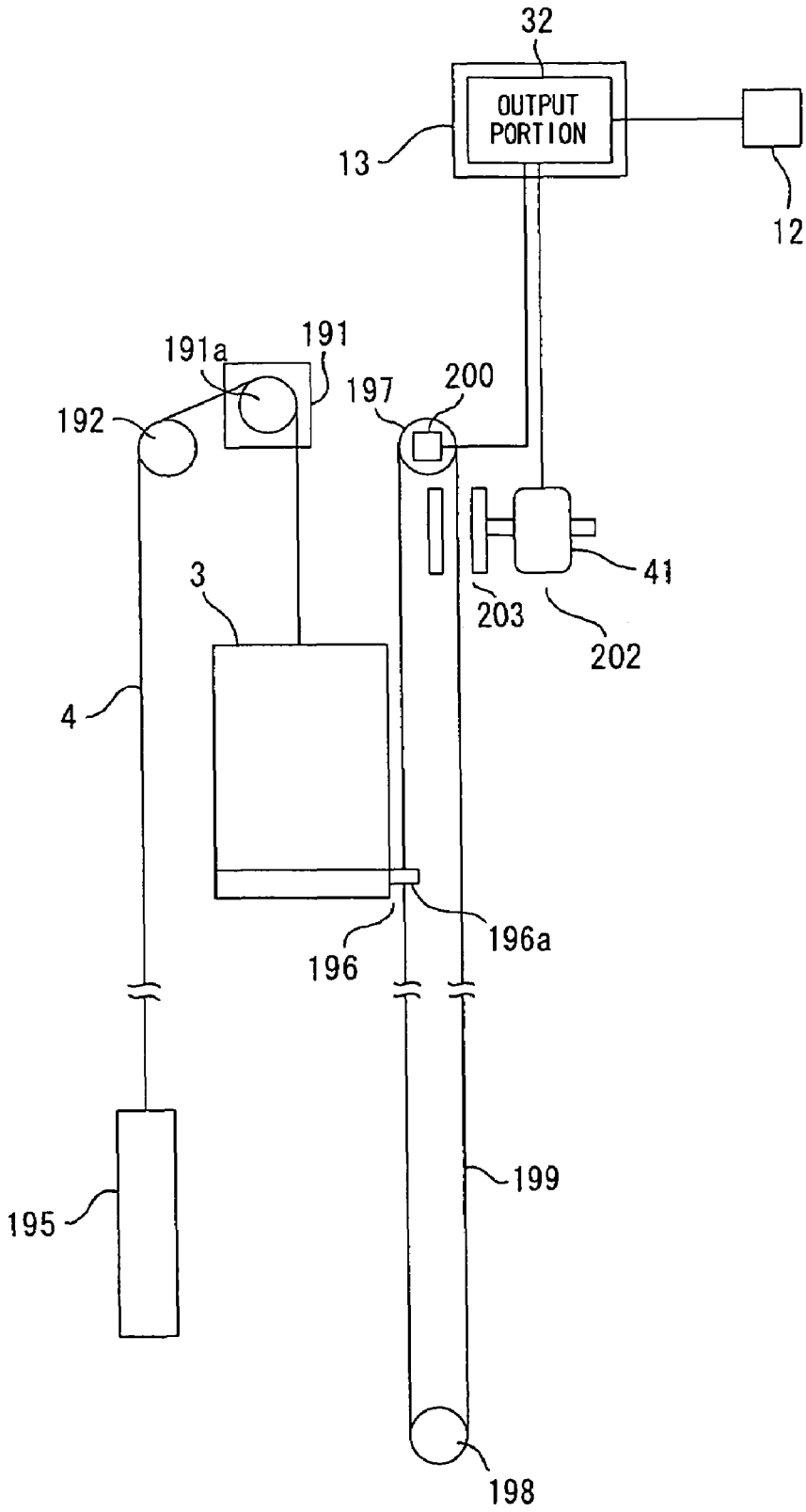
FIG. 11 is a constructional view showing an elevator apparatus according to Embodiment 4 of the present invention.

FIG. 11 is a constructional view showing an elevator apparatus according to Embodiment 4 of the present invention. A driving device (hoisting machine) 191 and a deflector sheave 192 are provided in an upper portion within a hoistway. The main rope 4 is wrapped around a driving sheave 191*a* of the driving device 191 and the deflector 192. The car 3 and a counter weight 195 are suspended in the hoistway by means of the main rope 4.

A mechanical safety device 196 which is engaged with a guide rail (not shown) in order to stop the car 3 in case of emergency is installed in a lower portion of the car 3. A speed governor sheave 197 is disposed in the upper portion of the hoistway. A tension sheave 198 is disposed in a lower portion of the hoistway. A speed governor rope 199 is wrapped around the speed governor sheave 197 and the tension sheave 198. Both end portions of the speed governor rope 199 are connected to an actuator lever 196*a* of the safety device 196. Consequently, the speed governor sheave 197 is rotated at a speed corresponding to a running speed of the car 3.

The speed governor sheave 197 is provided with a sensor 200 (e.g., an encoder) for outputting a signal used to detect the position and a speed of the car 3. The signal from the sensor 200 is input to the output portion 32 installed in the control panel 13.

A speed governor rope holding device 202 that holds the speed governor rope 199 to stop circulation thereof is provided in the upper portion of the hoistway. The speed governor rope holding device 202 has a hold portion 203 that holds the speed governor rope 199, and the actuator 41 that drives the hold portion 203. Embodiment 4 is the same as Embodiment 1 in respect of the construction and operation of the actuator 41. Embodiment 4 is the same as Embodiment 1 in respect of other constructional details.

Next, an operation will be described. During normal operation, the movable iron core 48 of the actuator 41 is at the normal position (FIG. 4). In this state, the speed governor rope 199 is opened and separated from the hold portion 203 instead of being fastened.

When the speed detected by the sensor 200 becomes equal to the first overspeed, the braking device of the driving device 191 is actuated. When the speed of the car 3 rises thereafter as well and the speed of the car 3 detected by the sensor 200 becomes equal to the second overspeed, an actuation signal is outputted from the output portion 32. When the actuation signal from the output portion 32 is inputted to the speed governor rope holding device 202, the movable iron core 48 of the actuator 41 is displaced from the normal position to the actuation position (FIG. 5). The hold portion 203 is thereby displaced in such a direction as to hold the speed governor rope 199, so that the speed governor rope 199 is stopped from moving. When the speed governor rope 199 is stopped, an actuator lever 196*a* is operated due to the movement of the car 3. As a result, the safety device 196 is operated to stop the car 3 as an emergency measure.

During recovery, a recovery signal is outputted from the output portion 32 to the speed governor rope holding device 202. When the recovery signal from the output portion 32 is inputted to the speed governor rope holding device 202, the movable iron core 48 of the actuator 41 is displaced from the actuation position to the normal position (FIG. 6). The speed governor rope 199 is thereby released from being fastened by the hold portion 203. After that, the car 3 is raised to render the safety device 196 inoperative. As a result, the car 3 is allowed to travel.

Embodiment 4 is the same as Embodiment 1 in respect of the procedure of inspecting for the presence or absence of an abnormality in the charging capacitor 91 (FIG. 6) and the operation during the inspection.

Thus, with the elevator apparatus having a structure in which the safety device 196 is operated by fastening the speed governor rope 199 as well, the same actuator 41 as that of Embodiment 1 can be employed as a driving portion for operating the safety device 196.

Further, as described above, with the elevator apparatus having a structure in which an actuation signal from the output portion 32 is inputted to the electromagnetically driven speed governor rope holding device 202 as well, it is possible to easily and more reliably check whether or not there is the presence or absence of a capacitance shortage of the charging capacitor 91 by applying the failure detecting device 92 (FIG. 6) to the feeder circuit 55.

In the above example, the failure detecting device 92 is applied to the same feeder circuit 55 as that of Embodiment 1. However, the failure detecting device 92 may also be applied to the same feeder circuit 55 as that of Embodiment 2 or 3. In this case, the operation of the actuator 41 is also inspected in inspecting for a capacitance shortage of the charging capacitor.

Further, although the output portion 32 is provided with the feeder circuit 55 for supplying an actuating electric power to the actuator 41 in Embodiments 1 to 3, the car 3 may be mounted with the feeder circuit 55. In this case, an actuation signal outputted from the output portion 32 serves as a signal for actuating the discharge switch 58. Due to actuation of the discharge switch 58, the actuating electric power is selectively supplied from the charging capacitor (normal mode capacitor) to one of the first coil 51 and the second coil 52.

The invention claimed is:

1. A failure detecting device for an elevator drive power source for detecting whether or not there is an abnormality in a charging capacitance of a charge portion serving as a drive power source that drives an actuator for operating a safety device of an elevator, characterized by comprising:

a determination device comprising: a storage portion in which an upper limit and a lower limit of a charging time of the charge portion at a time when the charging capacitance is normal are stored in advance; and a processing portion which can measure the charging time of the charge portion, for detecting whether or not the charging time is between the upper limit and the lower limit.

2. A failure detecting method for an elevator drive power source for detecting whether or not there is an abnormality in a charging capacitance of a charge portion serving as a drive power source that drives an actuator for operating a safety device of an elevator, characterized by comprising the steps of:

measuring a charging period of time until a charging voltage of the charge portion becomes equal to a set voltage when charging the charge portion, by means of a processing portion; and detecting whether or not the charging time is within a predetermined set range, by means of the processing portion.

* * * * *